US005845852A

United States Patent [19]

Waldman et al.

[11] Patent Number: 5,845,852

[45] Date of Patent: Dec. 8, 1998

[54] DIRECT OPERATED CHECK INJECTOR

[75] Inventors: Donald John Waldman, Brimfield; Keith Edward Lawrence; Steven James Funke, both of Peoria, all of Ill.; Craig William Lohmann, Denver, Iowa

[73] Assignee: Caterpillar Inc., Peoria, Ill.

[21] Appl. No.: 751,106

[22] Filed: Nov. 15, 1996

Related U.S. Application Data

[63] Continuation-in-part of Ser. No. 458,985, Jun. 2, 1995, abandoned.

[51] Int. Cl.[6] ..... F02M 47/02

[52] U.S. Cl. ..... 239/533.8

[58] Field of Search ..... 239/533.8, 533.3, 239/95, 397.5, 88

[56] References Cited

U.S. PATENT DOCUMENTS

| | | | |
|---|---|---|---|
| 3,323,726 | 6/1967 | Heintz | 239/533 |
| 3,680,782 | 8/1972 | Monpetit et al. | 239/533.8 X |
| 3,738,576 | 6/1973 | O'Neill | 239/533.8 |
| 3,753,426 | 8/1973 | Lilley | 123/139 |
| 4,022,166 | 5/1977 | Bart | 123/32 JV |
| 4,360,163 | 11/1982 | Williams | 239/533.5 |
| 4,414,940 | 11/1983 | Loyd | 123/299 |
| 4,471,256 | 9/1984 | Igashira et al. | 310/328 |
| 4,584,980 | 4/1986 | Weiger et al. | 123/458 |
| 4,684,104 | 8/1987 | Micard | 251/129.05 |
| 4,709,679 | 12/1987 | Djordjevic et al. | 123/447 |
| 4,728,074 | 3/1988 | Igashira et al. | 251/57 |
| 4,784,102 | 11/1988 | Igashira et al. | 12/447 |
| 4,821,726 | 4/1989 | Tamura et al. | 123/498 |

(List continued on next page.)

FOREIGN PATENT DOCUMENTS

| | | | |
|---|---|---|---|
| 0 199 632 A1 | 10/1986 | European Pat. Off. . | |
| 0 304 745 | 3/1989 | European Pat. Off. . | |
| 0 318 743 | 6/1989 | European Pat. Off. . | |
| 0 331 198 | 9/1989 | European Pat. Off. . | |
| 0 397 106 | 11/1990 | European Pat. Off. . | |
| 2 028 442 | 6/1970 | Germany . | |
| 4115477 | 11/1991 | Germany | 239/533.8 |
| 61-149 568 | 7/1986 | Japan . | |
| 1 097 752 | 1/1968 | United Kingdom . | |
| 2 203 795 | 10/1988 | United Kingdom . | |

OTHER PUBLICATIONS

SAE Paper 910252, "Development of New Electronically Controlled Fuel Injection System ECD–U2 for Diesel Engines," Miyaki, Masahiko, et al., Nippondenso Co., Ltd.

Gibson et al. U.S. Patent application Serial No. 08/172,881.

Prescher, K., et al., "Common Rail Injection Systems with Characteristics Independent of Engine Speed and with High Injection Pressure—Diesel Engine Potential for the future," except from European publication, presented at the Vienna Motor Symposium, Apr. 1994, pp. 54–79, with translation.

Egger, K., et al., "Common Rail Injection System for Diesel Engines—Analysis, Potential, Future,"60 excerpt from unknown European publication, pp. 36–53, presented at the Vienna Motor Symposium, Apr. 1994, with translation.

"Injection Equipment for Diesels of the Future, Bosch displays its more efficient fuel injection technology designs for tomorrow's electronic, low emission engines," *High Speed Diesels & Drives,* pp. 16, 18, (publication date unknown).

Bosch schematic drawing entitled "Common Rail–System".

*Primary Examiner*—Kevin Weldon

*Attorney, Agent, or Firm*—Marshall O'Toole,Gerstein, Murray & Borun

[57] ABSTRACT

A fuel injector includes an injector body and a three-way control valve having a valve element movable between first and second positions in the injector body. A check is disposed in the injector body and is movable to inject fuel when the control valve is in the second position and to block fuel injection when the control valve is in the first position. An actuator is selectively operable to move the valve element between the first and second positions. The injector includes a single clearance fit located in the control valve wherein the clearance fit is not exposed to a substantial pressure differential when the control valve is in the first position.

30 Claims, 6 Drawing Sheets

U.S. PATENT DOCUMENTS

| | | | |
|---|---|---|---|
| 4,838,233 | 6/1989 | Hayashi et al. | 123/506 |
| 4,946,106 | 8/1990 | Turchi et al. | 239/533.8 X |
| 4,993,636 | 2/1991 | Taue et al. | 239/533.8 |
| 5,004,945 | 4/1991 | Tomita et al. | 310/328 |
| 5,011,082 | 4/1991 | Ausiello et al. | 239/585 |
| 5,053,668 | 10/1991 | Mitsuyasu | 310/317 |
| 5,080,079 | 1/1992 | Yoshida et al. | 123/531 |
| 5,167,370 | 12/1992 | Henkel | 239/533.8 |
| 5,191,867 | 3/1993 | Glassey | 123/446 |
| 5,335,861 | 8/1994 | Matasaka | 239/533.8 X |
| 5,397,055 | 3/1995 | Paul et al. | 239/533.8 X |
| 5,452,858 | 9/1995 | Tsuzuki et al. | 239/533.8 |
| 5,542,610 | 8/1996 | Augustias | 239/533.8 |

Fig. 1
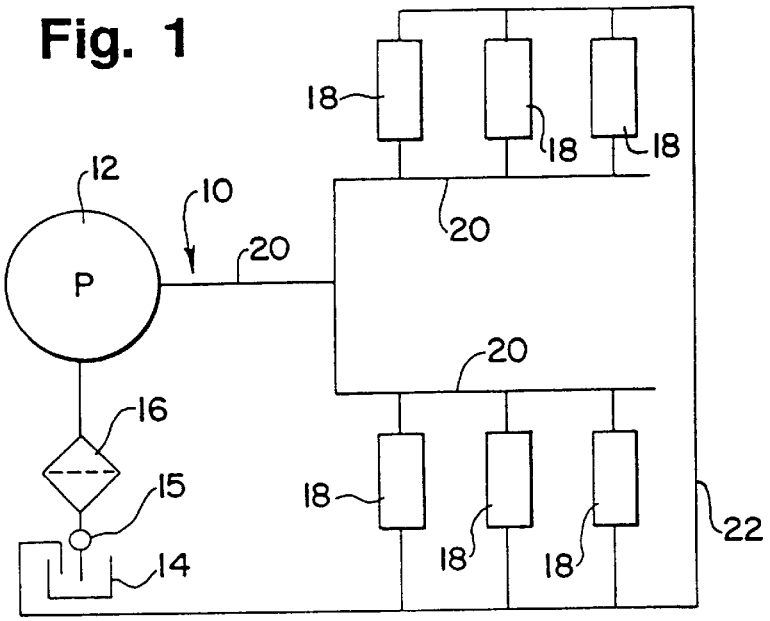
Fig. 2
PRIOR ART
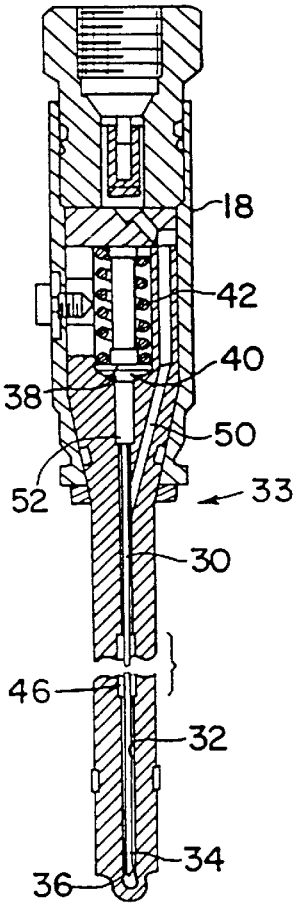
Fig. 3
PRIOR ART
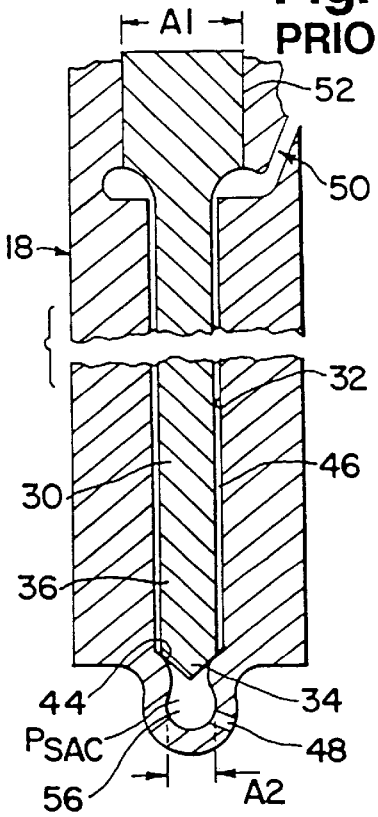
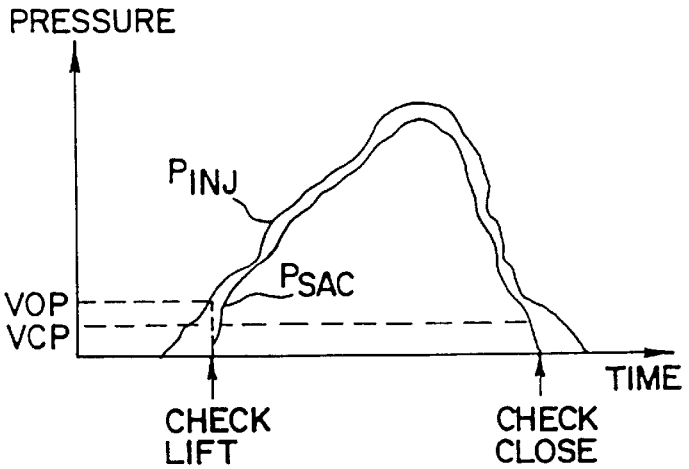
Fig. 4 PRIOR ART

DIRECT OPERATED CHECK INJECTOR

CROSS REFERENCE TO RELATED APPLICATION

The present application comprises a continuation-in-part of U.S. application Ser. No. 08/458,985, filed Jun. 2, 1995, now abandoned.

TECHNICAL FIELD

The present invention relates generally to fuel injectors, and more particularly to a fuel injector having a directly operated check.

BACKGROUND ART

Prior fuel injection systems which may be used with, for example, diesel engines, have typically been of the pump-line-injector type or the unit injector type. A pump-line-injector fuel injection system includes a main pump which pressurizes fuel to a high level, e.g., on the order of 103 to 138 MPa (about 15,000 to 20,000 p.s.i.), and individual fuel injectors which are coupled by fuel supply lines to the pump. In a unit injector system, a low-pressure pump delivers fuel to a plurality of unit injectors, each of which includes means for pressurizing the fuel to a relatively high value, again on the order of 103 to 138 MPa (about 15,000 to 20,000 p.s.i.) or greater.

A common feature of these types of injection systems is that each injector injects fuel into individual engine combustion chambers through individual, timed pressurization-depressurization events within an injection chamber having a check at one end thereof. Each check has a tip which is biased against a valve seat by a spring. When fuel is to be injected into an associated engine combustion chamber, a controlling exit passage from the injection chamber is abruptly closed, causing a rapid build-up of pressure within the chamber. When the fuel pressure overcomes the spring force exerted on the check, the check is lifted, thereby spacing the check tip away from the valve seat and permitting pressurized fuel to escape into the associated engine combustion chamber through one or more injector nozzle orifices. Injection is conventionally ended by abruptly reopening the controlling exit passage, thereby depressurizing the chamber sufficiently that the check biasing spring forces the check against the valve seat.

While conventional injection apparatus of the foregoing type have been useful to control the admittance of pressurized fuel into an associated engine combustion chamber relative to approximately top dead center (TDC), such apparatus is only indirectly controlled, i.e., the motive force for moving the injector check is provided by the pressurized fuel itself rather than a directly controllable motive power source. Accordingly, the degree of controllability required to desirably reduce particulate and gaseous emissions in accordance with regulatory agency standards is minimal.

Gibson et al. U.S. patent application Ser. No. 08/172,881 discloses a fuel injector having a force-balanced check which is movable between open and closed positions by means of a low-force actuator. This fuel injector provides a high degree of controllability and is capable of use with high fuel injection pressures, thereby permitting a desirable reduction in undesirable exhaust emissions.

SAE paper 910252 by Miyaki et al. discloses a fuel injector utilizing a three-way valve to control injection by controlling the application of fluid pressure from a high pressure source to ends of a check. The injector is designed to minimize biasing forces resulting from fluid pressure differentials tending to urge the three-way valve toward either the first or second travel limit positions. This is accomplished by incorporating an inner valve slidably fitted inside an outer valve which in turn is slidably fitted inside a valve body. The clearances between the inner and outer valve and between the outer valve and the valve body provide leakage paths which are continuously subjected to the high supply pressure. For most operating conditions of the intended diesel engine application the resulting leakage exceeds the amount of fuel injected into the associated engine cylinder, thus constituting a significant reduction in the efficiency of the injection system.

DISCLOSURE OF THE INVENTION

A fuel injector includes apparatus for directly and quickly moving the check of the fuel injector using components which are simple in design, rugged and reliable.

More particularly, a fuel injector includes an injector body assembly, a three-way control valve having a valve element movable between first and second positions and a check disposed in the injector body assembly and movable in response to fluid pressures applied to ends thereof to inject fuel into a combustion chamber when the control valve is in the second position and to block injection of fuel into the combustion chamber when a control valve is in the first position. An actuator is selectively operable to move the valve element between the first and second positions. The injector includes a single clearance fit disposed in the control valve which is not exposed to a substantial pressure differential when the control valve is in the first position. The injector thus includes a leakage path only when the valve is in the second position, i.e., during injection.

According to a preferred embodiment, means are provided for maintaining a fluid pressure differential across the valve element whereby the valve is biased toward the first position.

Further in accordance with a preferred embodiment, the actuator comprises a solid state motor, for example, having at least one piezoelectric element, which is actuable to move a piston into engagement with the valve element.

Further in accordance with this aspect of the invention, the valve element is disposed in a valve element chamber and the surface defines a first bore which slidably receives one of the check ends to establish the clearance fit. The valve element further includes a second bore extending between the first bore and the valve element chamber. Also, the valve element chamber is defined by first and second valve seats and the valve element includes first and second sealing surfaces engageable with the first and second valve seats, respectively.

Still further in accordance with this aspect of the present invention, the first and second sealing surfaces are annular in shape and engage the first and second valve seats, respectively, when the valve element is in the first and second positions, respectively. Moreover, the valve element chamber is placed in fluid communication with a source of high pressure fluid when the valve element is in the first position and is placed in fluid communication with the source of low pressure fluid when the valve element is in the second position.

Also preferably, another of the check ends is in fluid communication with the source of high pressure fluid through a single conduit in the injector body assembly. Still further in accordance with the preferred embodiment, the fluid pressures are applied by fuel.

Optionally, a preload assembly may be provided for maintaining contact between the actuator and the valve element. The preload assembly includes an equalization valve coupled between a fluid pressure source and a piston of the actuator. According to one embodiment, the equalization valve includes a plate check movable between seats defining a valve chamber in fluid communication between the high pressure source and the cavity between the solid state motor and the piston. The equalization valve may further include a spring biasing the plate check against one of the seats and a vent notch adjacent one of the valve seats for permitting fluid flow past the plate check when the plate check engages the one valve seat.

According to an alternative embodiment, the equalization valve includes a valve stem movable between travel limits wherein the valve stem includes an annular groove in fluid communication with the fluid pressure source when the valve stem is at one of the travel limits and a bore in fluid communication between the annular groove and a cavity disposed between a solid state motor and the piston of the actuator. A spring may further be provided to bias the valve against the piston.

According to a further aspect of the present invention, a fuel injector for injecting fuel into a combustion chamber includes an injector body assembly and an elongate check disposed within the injector body assembly. The check is movable along a certain direction between an open position at which fuel is injected into the combustion chamber and a closed position at which fuel is not injected into the combustion chamber. A three-way valve includes a valve element movable between a first position within a valve element chamber wherein a first sealing surface of the valve element is disposed in sealing contact with a first valve seat and a second position within the valve element chamber wherein a second sealing surface of the valve element is disposed in sealing contact with the second valve seat. The valve element further includes a first bore within which a first end of the check is disposed for movement along the certain direction and a second bore in fluid communication between the valve element chamber and the first end of the check. An actuator is coupled to the valve element for moving the valve element between the first and second positions and a source of low fluid pressure is in fluid communication with the first sealing surface of the valve element. A source of high fluid pressure is in fluid communication with the second sealing surface of the valve element and further is in fluid communication with the second end of the check.

Because the check of the fuel injector of the present invention is directly controlled, a fuel injection regime may be used which results in a reduction in undesirable emissions in the engine exhaust. Further, the present invention has no clearance-type leakage paths subjected to high supply pressure when the valve is in the first position. In the primary intended application, i.e., a diesel engine, the valve would be in the first position 95% or more of the time for most operating conditions, and hence leakage is substantially reduced.

BRIEF DESCRIPTION OF THE DRAWINGS

FIG. 1 comprises a combined schematic and block diagram of a common supply rail fuel injection system;

FIG. 2 comprises an elevational view, partly in section, of a prior art fuel injector;

FIG. 3 comprises an enlarged, fragmentary sectional view of the fuel injector of FIG. 2;

FIG. 4 comprises a graph illustrating the operation of the fuel injector of FIG. 2;

BEST MODE FOR CARRYING OUT THE INVENTION

Figure 5:
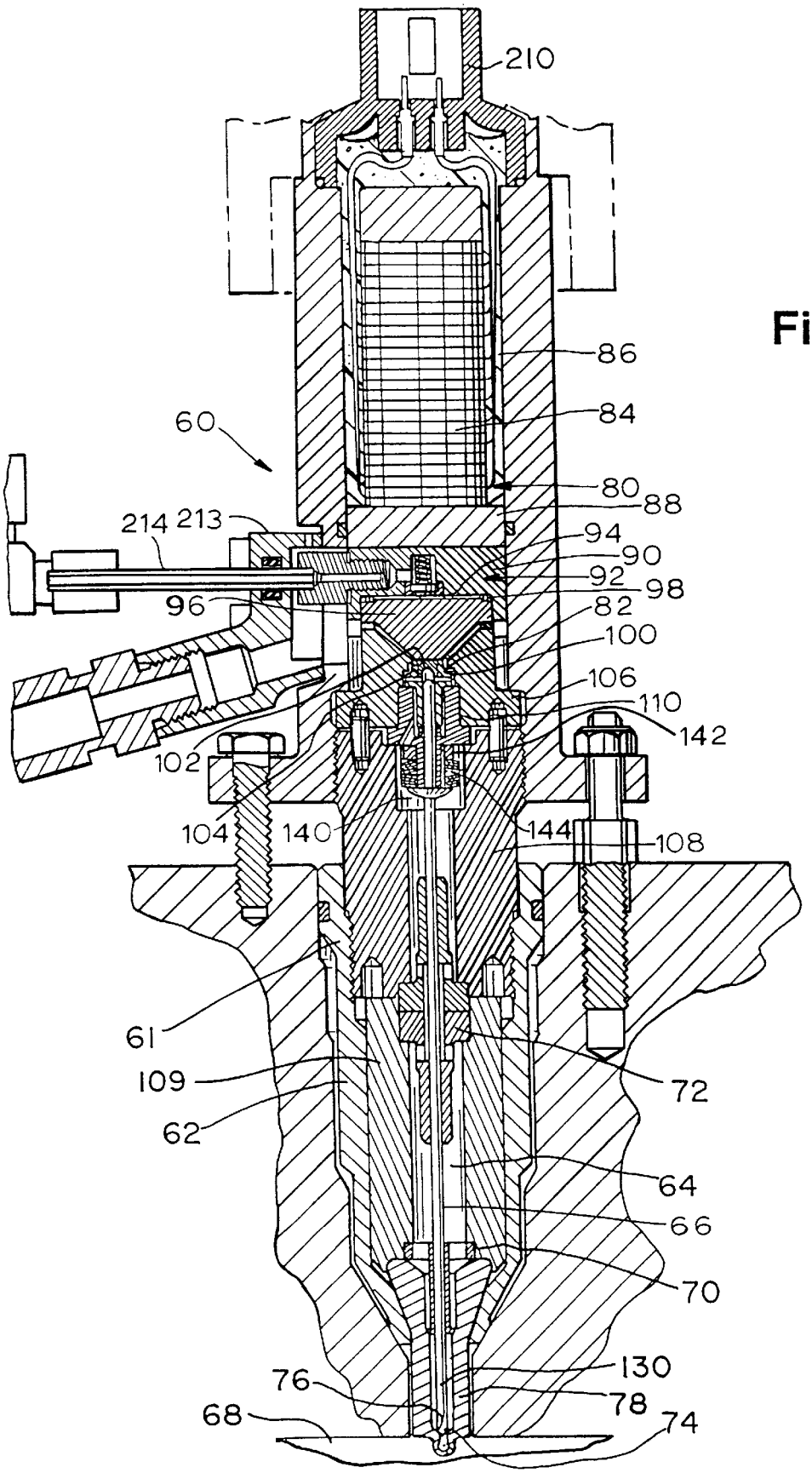
FIG. 5 comprises a full sectional view of a fuel injector according to the present invention.

Referring now to FIG. 1, a common supply rail fuel injection system 10 includes a high pressure pump 12 which receives fuel from a fuel tank 14, a transfer pump 15 and a filter 16 and delivers same under high continuous pressure, e.g., approximately 138 MPa (20,000 p.s.i.), to fuel injectors 18 via fuel supply lines or conduits 20. Fuel return lines 22 return fuel used as actuating fluid to the tank 14. The fuel injectors 18 inject fuel into associated combustion chambers or cylinders (not shown) of an internal combustion engine. While six fuel injectors 18 are shown in FIG. 1, it should be noted that a different number of fuel injectors may alternatively be used to inject fuel into a like number of associated combustion chambers. Also, the engine with which the fuel injection system 10 may be used may comprise a diesel-cycle engine, an ignition assisted engine or any other type of engine where it is necessary or desirable to inject fuel therein.

If desired, the fuel injection system 10 of FIG. 1 may be modified by the addition of separate fuel supply lines extending between the pump 12 and each injector 18 to obtain a pump-line-injector system wherein the pump 12 provides timed pressurization/depressurization events required to inject fuel into the cylinders via the separate supply lines. Alternatively, the system 10 may be modified to obtain a unit injector system wherein the pump 12 is omitted and the transfer pump 15 supplies fuel at a relatively low pressure of, for example, about 0.414 MPa (60 p.s.i.), to the injectors 18. In such a system, each injector 18 includes means for pressurizing the fuel to a relatively high pressure of, for example, about 138 MPa (20,000 p.s.i.).

FIG. 2 illustrates a prior art fuel injector 18 which is usable with the fuel injection system 10 of FIG. 1 configured as a pump-line-injector system. The fuel injector 18 includes a check 30 which resides within an injector bore 32 located in an injector body 33. The check 30 includes a sealing tip 34 disposed at a first end portion 36 and an enlarged plate or head 38 disposed at a second end portion 40. A spring 42 biases the tip 34 against a valve seat 44, shown in greater detail in FIG. 3, to isolate a fuel chamber 46 from one or more nozzle orifices 48.

The fuel injector 18 further includes a fuel inlet passage 50 which is disposed in fluid communication with a fuel supply line.

As seen specifically in FIG. 3, when fuel injection into an associated cylinder is to occur, pressurized fuel is admitted through the passage 50 into the space between the check 30 and the injector bore 32 and into the chamber 46. When the pressure $P_{INJ}$ within the chamber 46 reaches a selected valve opening pressure (VOP), check lift occurs, thereby spacing the tip 34 from the valve seat 44 and permitting pressurized fuel to escape through the nozzle orifice 48 into the associated combustion chamber. The pressure VOP is defined as follows:

$$VOP = \frac{S}{A1 - A2}$$

where S is the load exerted by the spring 42, A1 is the cross-sectional dimension of a valve guide 52 of the check 30 and A2 is the diameter of the line defined by the contact of the tip 34 with the valve seat 44.

At and following the moment of check lift, the pressure $P_{SAC}$ in an injector tip chamber 56 increases and then decreases in accordance with the pressure $P_{INJ}$ in the chamber 46 until a selected valve closing pressure (VCP) is reached, at which point the check returns to the closed position. The pressure VCP is determined in accordance with the following equation:

$$VCP = \frac{S}{A1}$$

where S is the spring load exerted by the spring 42 and where A1 is the cross-sectional diameter of the guide portion 52, as noted previously.

As the foregoing discussion demonstrates, opening and closing of the fuel injector 18 is accomplished only indirectly, i.e., by the force developed by the pressurized fuel admitted into the injector bore 32. One consequence of this fact is that the injector opening and closing pressures VOP and VCP are selected in advance by the overall design of the injector and cannot be readily changed. Further, the controllability of the injector 18 is severely limited, thereby limiting the opportunity to reduce gaseous and particulate emissions through control thereof.

FIG. 5 illustrates a fuel injector 60 according to the present invention which may be used as the fuel injector 18 in the high pressure common supply rail system of FIG. 1. Alternatively, if desired, a key feature of injector 60, i.e., means for directly and quickly moving the check, may be modified for use in a pump-line-injector or a unit injector system in a fashion known to one skilled in the art.

The fuel injector 60 includes an injector body assembly 61 including an injector case 62 and a cavity 64 therein. An elongate check 66 is disposed within the injector cavity 64 and is movable between a closed position seen in FIG. 5, at which fuel is not injected into an associated combustion chamber 68, and an open position at which fuel is injected into the combustion chamber 68. First and second check guides 70, 72 guide the check within the injector cavity 64 for movement between the two positions. When the check is in the first position, a tip 74 of the check seals against a seat 76 in a tip 78 of the injector.

Figure 6:
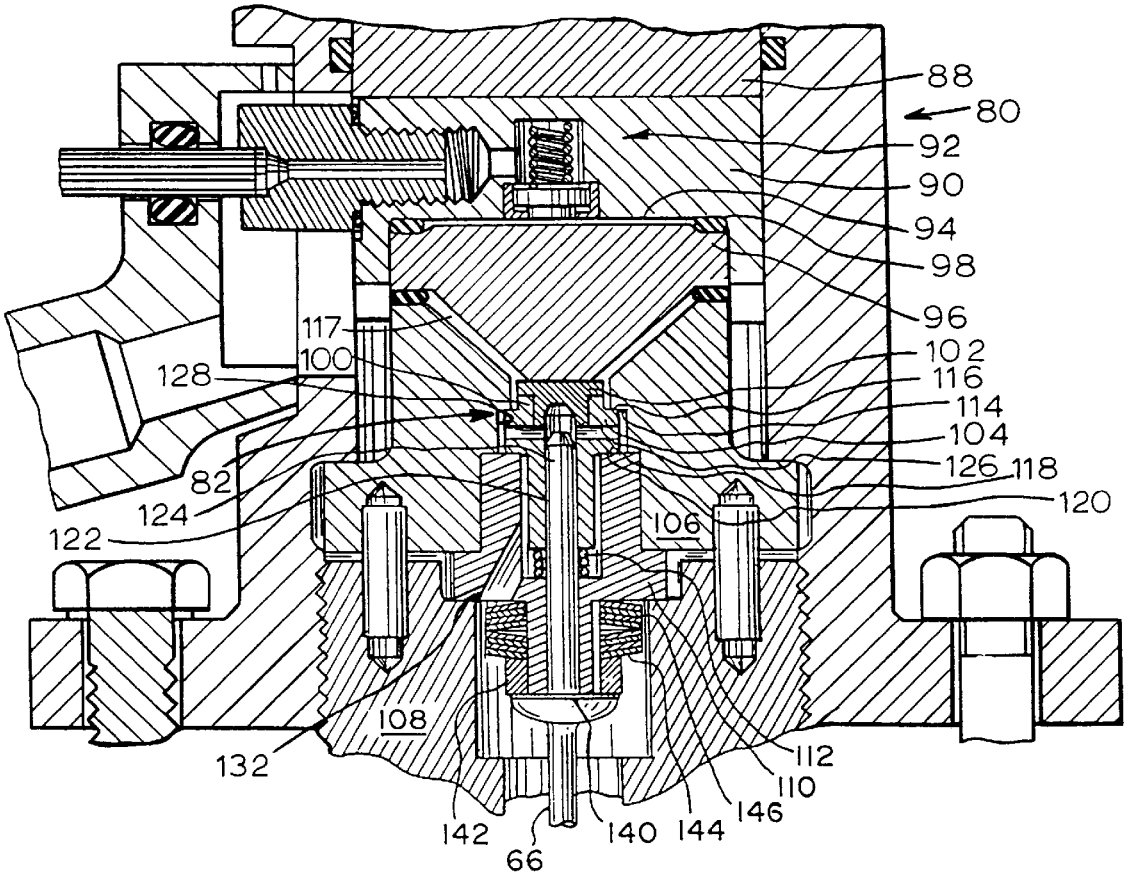
FIG. 6 comprises a partial sectional, enlarged view of a portion of the fuel injector of FIG. 5 illustrating the present invention in greater detail.

Referring also to FIG. 6, the injector 60 further includes an actuator 80 coupled to a three-way valve 82 which is in turn disposed in fluid communication with the check 66. In the preferred embodiment, the actuator 80 includes a solid state motor 84 comprising a plurality of stacked piezoelectric elements which are disposed within a recess 86. The stack of piezoelectric elements sits atop a movable end plate 88 which in turn bears against a valve housing 90 of an optional preload assembly 92. A cavity 94 is disposed between the valve housing 90 and a piston 96 and an O-ring 98 seals the cavity 94 against escape of pressurized fluid.

Figure 10:
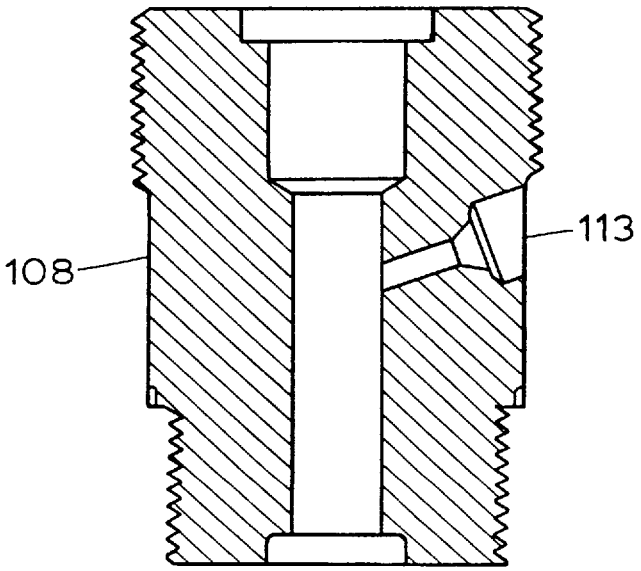
FIG. 10 comprises a sectional view of the upper body member 108 in a section plane displaced approximately 30° with respect to the section plane of FIG. 5.

A valve stem or member 100 of the three-way valve 82 may be of two-part construction including a nose piece 102 rigidly joined to a main body 104. Alternatively, the valve stem 100 may be of one-piece construction, if desired. A valve housing 106 is clamped or otherwise secured to an upper injector body member 108 and a central injector body member 109 is clamped between the upper injector body member 108 and the injector tip 78 by the injector case 62. The valve housing 106 comprises a first or upper stop. A second or lower stop 110 is captured between the valve housing 106 and the upper body member 108. A spring 112 (seen clearly in FIG. 6) biases the nose piece 102 and the main body 104 upwardly such that a first or upper annular sealing surface 114 carried by the main body 104 is disposed in sealing contact with a first or upper valve seat 116 when the motor 84 is not energized. If desired, an O-ring 115 may be provided between the piston 96 and the valve housing 106 to bias the piston 96 upwardly against the force exerted by the O-ring 98 to further insure that the surface 114 is in sealing contact with the upper valve seat 116. Alternatively, the O-ring 115 might be omitted, and an accumulator may be provided between the fuel pump and a fuel inlet 113 (FIG. 10) of the injector 60 to build up high fluid pressure which may be applied over a short period of time when the fuel injector 10 is initially pressurized to force the sealing surface 114 against the valve seat 116. As noted in greater detail hereinafter, the upper sealing surface 114 is disposed in fluid communication with a passage 117 which is coupled by passages (not shown) to a low pressure fluid source return line to sump, for example, one of the lines 22 of FIG. 1. The main body 104 further carries a second or lower annular sealing surface 118 which is adapted to sealingly contact a second or lower valve seat 120, as also noted in greater detail hereinafter. While not visible in the Figs. owing to the scale of the drawings, the axial distance between the sealing surfaces 114, 118 is slightly less than the distance between the valve seats 116, 120 so that the main body 104 is axially movable between the seats 116, 120.

The main body 104 and the nose piece 102 together define a longitudinal bore 122 within which an upper end 124 of the check 66 resides. One or more radial bores or holes 126 provide fluid communication between the longitudinal bore 122 and an element chamber 128 within which the main body 104 is disposed. The valve element chamber 128 and the valve stem 100 are disposed in fluid communication with a second end 130 of the check 66. One or more passages 132 couple a high pressure fluid source, for example, the high pressure pump 12 via one of the lines 20 of FIG. 1, to the valve element chamber 128, the valve stem 100 and the second end 130 of the check 66. As a result, the lower sealing surface 118 is in fluid communication with high pressure fluid.

Preferably, although not necessarily, only one conduit comprising one or more high pressure passages is formed in the injector 60 to supply high pressure fluid to the second end 130 of the check 66 so that fabrication is simplified.

As seen in FIG. 6, the check 66 includes an enlarged shouldered portion 140 upon which a spacer 142 and first and second pluralities of opposed belleville washers 144, 146 are disposed. The belleville washers 144, 146 are captured between and bias apart the shouldered portion 140 and an undersurface 148 of the lower stop 110. If desired, as seen in FIG. 5, the spacer 142 may be located atop the belleville washers 144, 146. The thickness of the spacer 142 is selected to obtain a proper preload for the belleville washers 144, 146. Also, the belleville washers may be replaced by one or more coil springs or any other type of biasing apparatus.

Figure 7:
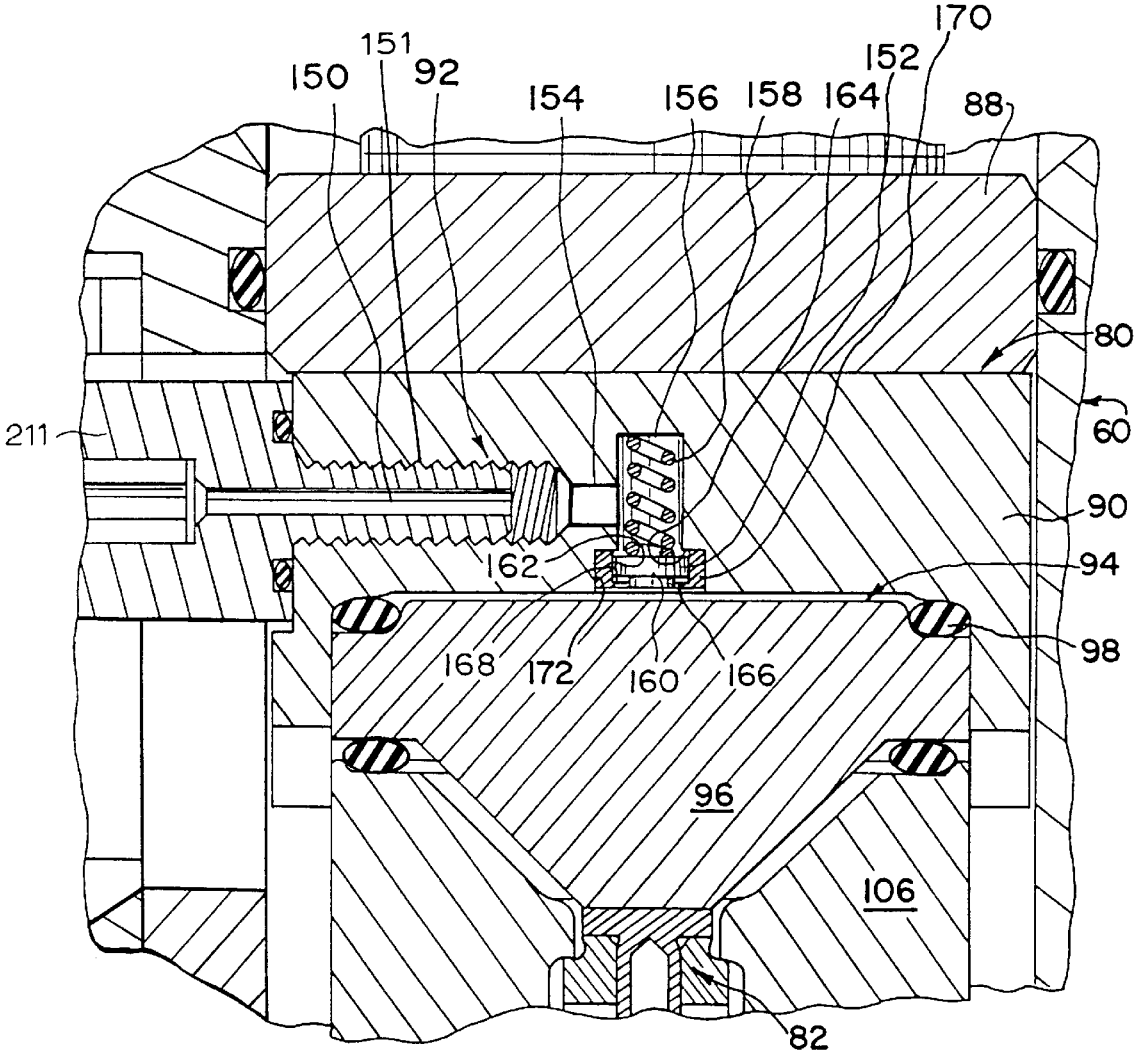
FIGS. 7 and 9 comprise enlarged views of a portion of FIG. 6 illustrating one embodiment of a preload assembly of the present invention.
Figure 9:
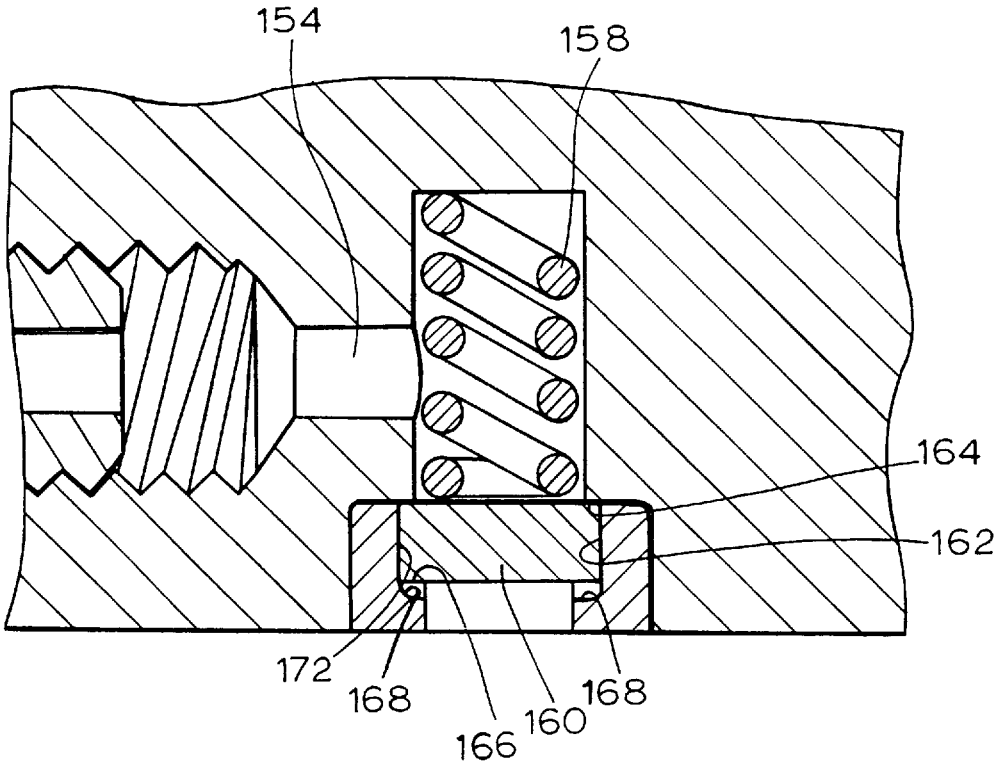

Referring now to FIGS. 7 and 9, the preload assembly 92 includes an inlet passage 150 formed in an inlet member 151 wherein the passage 150 is coupled to an intermediate pressure source which develops fluid pressure at a level less than, and preferably proportional to, the fluid pressure applied to the second end 130 of the check 66. In this fashion, the intermediate pressure magnitude will vary with the magnitude of the high pressure applied to the second end 130 so that proper operation is assured even when the high pressure magnitude varies widely. A plate valve 152 is disposed in fluid communication with the inlet passage 150 by means of an orifice 154 and a spring cavity 156 within which is located a spring 158. The plate valve includes a valve element in the form of a plate check 160 disposed within a valve chamber 162 defined in part by an upper seat 164 and a lower shouldered portion 166. The plate check 160 has an outer diameter less than the diameter of the valve chamber 162 to provide a clearance fit therebetween of approximately 0.0015 inch. In addition, at least one, and preferably two vent notches 168 are located adjacent the lower shouldered portion 166 and the valve chamber is formed within a cup holder 170 which is press fitted or otherwise secured within a bore 172 in the valve housing 90.

Figure 8:
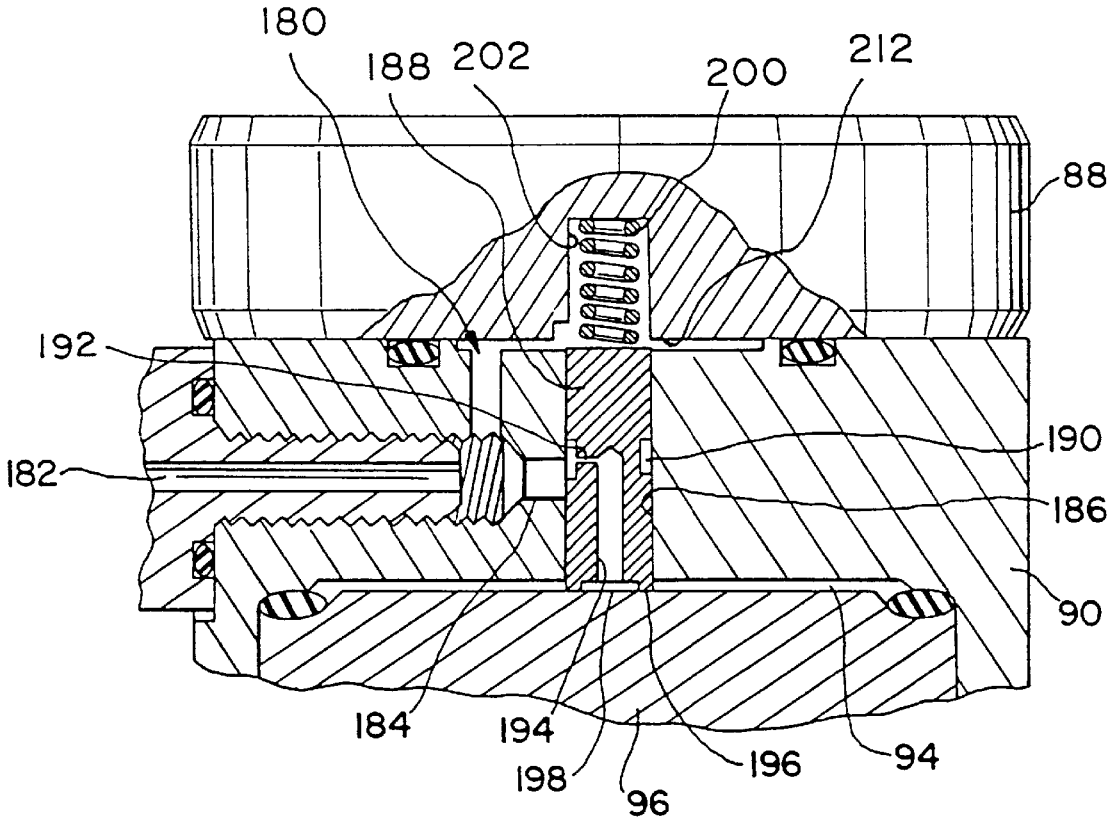
FIG. 8 comprises a view similar to FIG. 7 illustrating a further embodiment of a preload assembly of the present invention.

FIG. 8 illustrates a preload assembly 180 which may be used in place of the preload assembly 92. Elements common to FIGS. 1–8 are assigned like reference numerals.

The preload assembly 180 includes an inlet passage 182, similar to the inlet passage 150 of FIG. 7, which is coupled to the intermediate third pressure source. An orifice 184 is disposed in fluid communication between the inlet passage 182 and a valve chamber 186. A valve element in the form of a valve stem or spool 188 is disposed in sliding relationship within the valve chamber 186 and includes an annular groove 190, a radial bore 192 and a longitudinal bore 194. A bottom end 196 of the valve stem 188 is notched so that the inlet passage 182, the orifice 184, the annular groove 190, the radial bore 192, the longitudinal bore 194 and the cylindrical cavity 198 are in fluid communication with the cavity 94 above the piston 96 even when the valve stem 188 is in the position shown in FIG. 8 abutting the piston 96.

In addition to the foregoing, a spring 200 is disposed in a spring recess 202 and biases the valve stem 188 against the piston 96.

INDUSTRIAL APPLICABILITY

Referring again to FIGS. 5–7, when the various elements are in the positions shown in such figures, fluid at a controlled intermediate pressure is directed into the cavity 94 above the piston 96 via the inlet passage 150, the orifice 154, the spring cavity 156, the valve chamber 162 (wherein fluid flow occurs around the plate check 160) and the vent notches 168. If desired, the pressurized fluid at the intermediate pressure may be directed into the cavity 94 for only a relatively short period of time during which injection is to occur. The pressurized fluid hydraulically links the solid state motor 84, the plate 88 and the valve housing 90 with the piston 96. When the solid state motor 84 is actuated by a voltage applied thereto through a connector 210 (FIG. 5), the piezoelectric stack develops motive force which is transmitted through the movable plate 88 and the valve housing 90 to the piston 96 through the fluid in the cavity 94. This motive force causes the piston 96 to be displaced a certain limited amount in the downward direction as seen in FIGS. 6 and 7. This limited downward movement also moves the inlet member 151 downwardly a small amount, which movement is permitted by clearances with the plate 88 and the valve housing 90, as best seen in FIG. 7, and by a sealed clearance with a body 213, FIG. 5, which surrounds a tube 214 coupled to the inlet member 151 wherein the tube 214 has at least some degree of flexibility. In addition to the foregoing, at this time, the plate check 160 is moved upwardly against the upper valve seat 164 by the pressurized fluid in the cavity 94. During such movement, a very small amount of fluid is forced out of the cavity 94 through the check 160 (via the clearance fit between the plate check 160 and the valve chamber 162) and the orifice 154. It should be noted that the relative travel velocity between the plate check 160 and the seat 164 in the valve body 90 is substantially in excess of the relative travel velocity between the piston 96 and the valve body 90, owing to the differences in diameters thereof. The differences in diameter cause a high flow velocity past the plate check 160 so that a high pressure differential is developed thereacross, so that the force of the spring 158 is overcome. Also, the distance between the upper valve seat 164 and the lower shouldered portion 166 may be selected as desired, preferably equal to or less than 0.002 in. Therefore, the plate check 160 quickly comes into sealing contact with the upper valve seat 164 so that substantially all of the motive force developed by the solid state motor 84 is transferred to the piston 96.

As seen specifically in FIG. 6, downward movement of the piston 96 causes the upper sealing surface 114 to be spaced from the upper valve seat 116 and the lower sealing surface 118 to come into sealing contact with the lower valve seat 120. The radial bore 126, and hence the longitudinal bore 122 and the upper end 124 of the check 66, are thus exposed to low pressure fluid which is present in the passage 117. As noted previously, the second end 130 of the check 66 is exposed to high pressure fuel, for example on the order of or greater than 138 MPa (20,000 p.s.i.) which is delivered through the fuel inlet 113. The resulting net pressure imbalance forces the check 66 upwardly against the force of the belleville washers 144, 146 so that the upper end 124 of the check 66 moves upwardly within the longitudinal bore 122. Fuel injection then commences into the associated combustion chamber 68. When injection is to be terminated, the voltage is removed from the solid state motor 84, causing the motive force to be removed from the piston 96. This causes the valve member 100 to move upwardly under the combined forces of the high pressure below it and the spring 112 so that the upper sealing surface 114 comes into contact with the upper valve seat 116 and the lower sealing surface 118 moves out of contact with the lower valve seat 120. This movement causes the passage 132 to be placed in fluid communication with the radial bore 126, and thus the longitudinal bore 122 and the upper end 124 of the check 66, balancing the pressures applied to the ends 124, 130 of the check 66. The balancing of the fluid pressures on the ends of the check 66 permits the belleville washers 144, 146 to move the check 66 downwardly into engagement with the seat 76, as seen in FIG. 7, thereby terminating injection. In addition, the removal of voltage from the solid state motor 84 permits the spring 158 to move the plate check 160 downwardly into engagement with the lower valve seat 166 so that the inlet passage 150 is again placed in fluid communication with the cavity 94.

The preload assembly 92 compensates for injector build tolerances and thermal expansion variations. In this way, the solid state motor 84 and the three-way valve member 100 will always remain in contact ready to actuate the three-way valve 82. The mechanism functions as a self-locking hydraulic spring that stores hydraulic energy in the cavity 94. The intermediate pressure fluid supplied to the inlet passage 150 may be obtained from any convenient external hydraulic supply or by the pump 12, provided some means is used to reduce the hydraulic pressure to an acceptable intermediate level. The preload force exerted on the solid state motor 84 by the pressurized fluid also increases the effective stiffness of the solid state motor 84 over the operating range thereof and maximizes the displacement of the piston 96.

In summary, the self-locking preload assembly provides three important functions:

1. it compensates for dimensional changes and/or imperfections to maintain proper contact between the solid state actuator 80 and the three-way valve 82;

2. it offsets some of the upward force acting on the three-way valve 82 by the high supply pressure biasing the valve 82 toward the first, upper position, thus reducing the amount of force required by the solid state actuator 80 to move the valve 82 to the second, lower position; and 3. by presqueezing the solid state actuator 80 the preload assembly maximizes the stiffness and thereby the performance of the actuator 80.

Referring now to FIG. 8, the alternative preload assembly 180 also removes any assembly or thermal expansion backlash, increases the effective stiffness of the solid state motor 84 over the operating range thereof and maximizes the displacement of the piston 96. Prior to actuation of the solid state motor 84, the inlet passage 182 is disposed in fluid communication with the cavity 94 via the orifice 184, the annular groove 190, the radial bore 192 and the longitudinal bore 194. Further, the spring recess 202 is disposed in fluid communication with the inlet passage 182 so that the pressures across the valve stem 188 are balanced. When the solid state motor 84 is actuated, increased fluid pressure in the cavity 94 causes the valve stem 188 to be displaced upwardly against a stop 212. The travel velocity and travel distance of the valve stem 188 are greater than the travel velocity and travel distance of the piston 96 owing to the differences between the diameters thereof. During the time of movement of the valve stem 188, pressurized fluid escapes through the orifices 192 and 184, the rate of such escape being controlled by the size of the smaller of these orifices. As the valve stem 188 travels toward the stop 212, a metering edge 214 in part defining the axial limits of the annular groove 190 moves past the upper edge walls defining the orifice 184, thereby taking the cavity 94 out of fluid communication with the inlet passage 182. As was noted in connection with the embodiment of FIG. 7, the solid state motor 84 is thereafter hydraulically linked with the piston 96 so that the three-way valve 82 may be properly actuated.

When the solid state motor 84 is subsequently deactuated, the pressure in the cavity 94 drops, thereby allowing the spring 200 to move the valve stem 188 downwardly into contact with the piston 96, as seen in FIG. 8. Fluid communication is then reestablished between the inlet passage 182 and the cavity 94, as noted above.

The present fuel injector includes only a single clearance fit which is subjected to a substantial pressure differential. This clearance fit, which is located between the upper end 124 of the check 66 and the walls defining the bore 122, is subjected to the pressure differential for only the short periods of time during which fuel injection is to occur, i.e., only when fuel at the intermediate pressure is present in the cavity 94. Also, this clearance fit is located in the valve and has a relatively short spill path. Because of these factors, leakage is reduced and efficiency is increased.

If desired, the solid state motor 84 may be replaced by any other type of actuator, such as a solenoid-operated actuator.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A fuel injector, comprising an injector body assembly;

a three-way control valve having a valve element movable between first and second positions;

a check disposed in the injector body assembly and movable in response to fluid pressures applied to ends thereof to inject fuel into a combustion chamber when the control valve is in the second position and to block injection of fuel into the combustion chamber when the control valve is in the first position; and an actuator selectively operable to move the valve element between the first and second positions;

the injector including a clearance fit located in the control valve and partially defined by a portion of the check, such that the clearance fit is not exposed to a substantial pressure differential when the control valve is in the first position.

2. The fuel injector of claim 1, further including means for maintaining a fluid pressure differential across the valve element biasing the valve element toward the first position.

3. The fuel injector of claim 1, wherein the actuator comprises a solid state motor which is actuable to move a piston into engagement with the valve element.

4. The fuel injector of claim 3, wherein the solid state motor includes at least one piezoelectric element.

5. The fuel injector of claim 1, wherein the valve element is disposed in a valve element chamber and wherein the valve element includes a first bore which slidably receives one of the check ends to establish the clearance fit and further including a second bore extending between the first bore and the valve element chamber.

6. The fuel injector of claim 5, wherein the valve element chamber is defined by first and second valve seats and wherein the valve element includes first and second sealing surfaces engageable with the first and second valve seats, respectively.

7. The fuel injector of claim 6, wherein the first and second sealing surfaces are annular in shape and engage the first and second valve seats, respectively, when the valve element is in the first and second positions, respectively.

8. The fuel injector of claim 6, wherein the valve element chamber is placed in fluid communication with a source of high pressure fluid when the valve element is in the first position and is placed in fluid communication with a source of low pressure fluid when the valve element is in the second position.

9. The fuel injector of claim 8, wherein another of the check ends is in fluid communication with the source of high pressure fluid through a single conduit in the injector body.

10. The fuel injector of claim 1, wherein the fluid pressures are applied by fuel.

11. The fuel injector of claim 1, further including a preload assembly for maintaining contact between the actuator and the valve element.

12. The fuel injector of claim 11, wherein the actuator includes a solid state motor which is actuable to move a piston into engagement with the valve element and wherein the preload assembly includes an equalization valve coupled between fluid pressure source and the piston.

13. The fuel injector of claim 12, wherein a cavity is disposed between the solid state motor and the piston and wherein the equalization valve includes a valve stem movable between travel limits and including an annular groove in fluid communication with the fluid pressure source when the valve stem is at one of the travel limits and a bore in fluid communication between the annular groove and the cavity.

14. The fuel injector of claim 13, wherein the equalization valve further includes a spring biasing the valve stem toward one of the travel limits.

15. The fuel injector of claim 13, wherein the equalization valve further includes a spring biasing the valve stem against the piston.

16. A fuel injector for injecting fuel into a combustion chamber, comprising:

an injector body;

an elongate check disposed within the injector body and movable along a certain direction between an open position at which fuel is injected into the combustion chamber and a closed position at which fuel is not injected into the combustion chamber;

a three-way valve including a valve element movable between a first position within a valve element chamber wherein a first sealing surface of the valve element is disposed in sealing contact with a first valve seat and a second position within the valve element chamber wherein a second sealing surface of the valve element is disposed in sealing contact with a second valve seat and wherein the valve element further includes a first bore within which a first end of the check is disposed for movement along the certain direction and a second bore in fluid communication between the valve element chamber and the first end of the check;

an actuator coupled to the valve element for moving the valve element between the first and second positions;

a source of low fluid pressure in fluid communication with the first sealing surface of the valve element; and a source of high fluid pressure in fluid communication with the second sealing surface of the valve element and in fluid communication with the second end of the check.

17. The fuel injector of claim 16, wherein the actuator comprises a solid state motor which is movable into engagement with the valve element.

18. The fuel injector of claim 16, wherein the actuator includes a plurality of piezoelectric elements.

19. The fuel injector of claim 16, wherein the first and second sealing surfaces are annular in shape.

20. The fuel injector of claim 16, wherein the fluid pressures are applied by fuel.

21. The fuel injector of claim 16, further including a preload assembly for maintaining contact between the actuator and the valve element.

22. The fuel injector of claim 21, wherein the actuator includes a solid state motor which is actuable to move a piston into engagement with the valve element and wherein the preload assembly includes an equalization valve coupled between a fluid pressure source and the piston.

23. The fuel injector of claim 22, wherein a cavity is disposed between the solid state motor and the piston and wherein the equalization valve includes a plate check movable between seats defining a valve chamber in fluid communication between the fluid pressure source and the cavity.

24. The fuel injector of claim 23, wherein the equalization valve further includes a spring biasing the plate check against one of the seats.

25. The fuel injector of claim 24, wherein the plate check has an outer diameter smaller than a diameter of the valve chamber and further including a vent notch adjacent one of the valve seats for permitting fluid flow past the plate check when the plate check engages the one valve seat.

26. The fuel injector of claim 22, wherein a cavity is disposed between the solid state motor and the piston and wherein the equalization valve includes a valve stem movable between travel limits and including an annular groove in fluid communication with the fluid pressure source when the valve stem is at one of the travel limits and a bore in fluid communication between the annular groove and the cavity.

27. The fuel injector of claim 26, wherein the equalization valve further includes a spring biasing the valve stem against the piston.

28. The fuel injector of claim 16, wherein the fluid pressure source is in fluid communication with the second end of the check through a single conduit.

29. The fuel injector of claim 16, wherein a clearance fit is established between the first end of the check and the first bore and wherein the clearance fit is not exposed to a substantial pressure differential across ends thereof when the valve element is in the first position.

30. The fuel injector of claim 16, wherein the valve element is spring-biased toward the first position.

* * * * *